US009682327B2

(12) United States Patent
Bashaw et al.

(10) Patent No.: US 9,682,327 B2
(45) Date of Patent: Jun. 20, 2017

(54) TOY LAUNCHER

(71) Applicant: Mattel, Inc., El Segundo, CA (US)

(72) Inventors: Douglas E. Bashaw, Burbank, CA (US); Christian Colquhoun, Los Angeles, CA (US); Paul Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/817,440

(22) Filed: Aug. 4, 2015

(65) Prior Publication Data

US 2016/0038844 A1 Feb. 11, 2016

Related U.S. Application Data

(60) Provisional application No. 62/033,560, filed on Aug. 5, 2014.

(51) Int. Cl.
*A63H 29/00* (2006.01)
*A63H 17/00* (2006.01)

(52) U.S. Cl.
CPC ..... *A63H 17/008* (2013.01)

(58) Field of Classification Search
USPC ... 446/6, 429, 430, 431, 433, 435, 444, 445, 446/446, 457, 459, 465
See application file for complete search history.

(56) References Cited

U.S. PATENT DOCUMENTS 1,159,928 A 2/1875 Hotchkiss
2,089,594 A 8/1937 Ballwanz
2,099,957 A 11/1937 Graham
2,383,559 A 8/1945 Parker
2,531,056 A 12/1949 Koesten
2,517,084 A 8/1950 Carver
2,563,969 A 8/1951 Skinner
2,627,853 A 2/1953 Koepnick
3,126,880 A 3/1964 Loe
3,562,949 A 2/1971 Beny
3,585,751 A 6/1971 Beny
3,600,850 A 8/1971 Summerfield
(Continued)

*Primary Examiner* — Kurt Fernstrom
(74) *Attorney, Agent, or Firm* — Edell, Shapiro & Finnan, LLC

(57) ABSTRACT

Disclosed herein is a toy launcher including a base having a slot and a housing movably coupled to move along the slot. The housing has a latch pivotally coupled to the housing and the latch has a first portion and a second portion. The weight of the first portion of the latch is greater than the weight of the second portion of the latch. The second portion of the latch engages with a toy and the first portion of the latch corresponds to a rear portion of the toy. A first engagement element is coupled to the base near a first end of the base and a second engagement element is coupled to the housing and movable along the slot. The second engagement element is configured to couple with the first engagement element to retain the housing in a fixed position against a force of a biasing member. A release mechanism is coupled to the base. The release mechanism is configured to disengage the first engagement element from the second engagement element so that the biasing member moves the housing and the latch away from the first engagement element and the latch pushes the toy to launch the toy from the base.

20 Claims, 8 Drawing Sheets

(56) References Cited

U.S. PATENT DOCUMENTS

| | | | | |
|---|---|---|---|---|
| 3,605,631 | A | 9/1971 | See | |
| 3,750,328 | A | 8/1973 | Nielsen | |
| 3,757,459 | A | 9/1973 | Buck | |
| 3,762,095 | A | 10/1973 | Merino | |
| 3,777,391 | A | 12/1973 | Barcus | |
| 3,789,542 | A | 2/1974 | Sims | |
| 3,797,164 | A | 3/1974 | Glass | |
| 3,798,832 | A | 3/1974 | Terzian | |
| 3,803,756 | A | 4/1974 | Strongin | |
| 3,877,169 | A | 4/1975 | Munday | |
| 3,886,682 | A | 6/1975 | Ieda | |
| 3,895,459 | A | 7/1975 | Morrison | |
| 3,905,350 | A | 9/1975 | Becker | |
| 3,908,303 | A | 9/1975 | McKay | |
| 3,949,729 | A | 4/1976 | Pfotenhauer | |
| 4,064,647 | A | 12/1977 | Lemelson | |
| 4,108,437 | A | 8/1978 | DeAnda | |
| 4,146,991 | A | 4/1979 | Sano | |
| 4,169,333 | A | 10/1979 | St. Clair | |
| 4,267,661 | A | 5/1981 | Hanson | |
| 4,345,402 | A | 8/1982 | Hanson | |
| 4,403,440 | A | 9/1983 | Wulff | |
| 4,443,966 | A | 4/1984 | Birdsall | |
| 4,483,096 | A | 11/1984 | Gabler | |
| 4,501,567 | A | 2/1985 | Cathell | |
| 4,690,658 | A | 9/1987 | Crosson | |
| 4,732,569 | A | 3/1988 | Hippely | |
| 4,897,065 | A | 1/1990 | Fertig | |
| 5,052,973 | A | 10/1991 | Rudell | |
| 5,154,657 | A | 10/1992 | Wildman | |
| 5,254,030 | A | 10/1993 | Ostendorff | |
| 5,316,514 | A | 5/1994 | Ellman | |
| 5,433,641 | A | 7/1995 | Rudell | |
| 5,496,202 | A | 3/1996 | Pons | |
| 5,643,040 | A * | 7/1997 | Hippely | A63H 18/026 446/423 |
| 5,674,105 | A | 10/1997 | Hamlin | |
| 6,000,992 | A * | 12/1999 | Lambert | A63H 18/026 446/430 |
| 6,500,042 | B1 | 12/2002 | LaPointe | |
| 7,934,970 | B2 | 5/2011 | O'Connor | |
| 8,298,035 | B2 | 10/2012 | O'Connor | |
| 8,388,405 | B2 * | 3/2013 | Desent | A63H 17/008 446/429 |
| 2007/0099541 | A1 | 5/2007 | Yu | |
| 2011/0244756 | A1 | 10/2011 | Christoffel | |
| 2011/0294395 | A1 * | 12/2011 | O'Connor | A63H 18/023 446/429 |
| 2015/0343319 | A1 * | 12/2015 | O'Connor | A63H 17/008 446/429 |

* cited by examiner

TOY LAUNCHER

CROSS-REFERENCE TO RELATED APPLICATION

This application claims priority to and the benefit of U.S. Provisional Patent Application No. 62/033,560, filed Aug. 5, 2014, entitled "Toy Launcher" the entire disclosure of which is incorporated herein by reference in its entirety.

BACKGROUND OF THE INVENTION

Many toy track sets have been developed which include a toy launcher. Toy launchers have long been a source of entertainment for children. The object of the launcher is to impart kinetic energy to the toy and propel it forward onto a track or other travel area. The variation in themes, features and arrangements spark the imagination of a child and provide continued engagement which adds to the play value.

Due to the continued popularity, there remains a continuing need in the art for ever more interesting, amusing and entertaining toy launchers. Also, a need exists for a toy launcher that can be utilized to launch or propel toy vehicles with different structures.

SUMMARY OF THE INVENTION

Disclosed herein is a toy launcher comprising a base having a slot, and a housing movably coupled to move along the slot. The housing has a latch pivotally coupled to the housing, and the latch has a first portion and a second portion. The weight of the first portion of the latch is greater than the weight of the second portion of the latch. The second portion of the latch engages with a toy, and the first portion of the latch corresponds to a rear portion of the toy. A first engagement element is coupled to the base near a first end of the base, and a second engagement element is coupled to the housing and movable along the slot. The second engagement element is configured to couple with the first engagement element to retain the housing in a fixed position against a force of a biasing member. A release mechanism is coupled to the base. The release mechanism is configured to disengage the first engagement element from the second engagement element so that the biasing member moves the housing and the latch away from the first engagement element and the latch pushes the toy to launch the toy from the base.

In one embodiment, a toy launcher comprises a base having a slot; a housing movably coupled to move along the slot, the housing having a latch pivotally coupled to the housing, the latch having a first portion and a second portion, wherein a weight of the first portion of the latch is greater than the weight of the second portion of the latch such that the first portion extends downward and the second portion extends upward relative to the base, and wherein the second portion of the latch engages with a toy; a biasing member coupled to the housing to bias the housing from a first position toward a second position relative to the base; and a release mechanism coupled to the base, wherein the release mechanism is actuatable to release the housing so that it can move toward the second position and push the toy to launch the toy from the base.

In one embodiment, the toy is a toy vehicle.

In one embodiment, the weight of the first portion of the latch is 10%-30% greater than the weight of the second portion of the latch.

In one embodiment, the latch at rest is oriented at approximately a 45 degree angle to a horizontal plane.

In one embodiment, the latch pivots along approximately a 180 degree angle.

In one embodiment, the biasing member is secured to the base. In one embodiment, the biasing member is a rubber band.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

In the present disclosure, disclosed herein, is a toy launcher comprising a base having a slot and a housing movably coupled to move along the slot. The housing has a latch pivotally coupled to the housing and the latch has a first portion and a second portion. The weight of the first portion of the latch is greater than the weight of the second portion of the latch. The second portion of the latch engages with a toy and the first portion of the latch corresponds to a rear portion of the toy. A first engagement element is coupled to the base near a first end of the base and a second engagement element is coupled to the housing and movable along the slot. The second engagement element is configured to couple with the first engagement element to retain the housing in a fixed position against a force of a biasing member. A release mechanism is coupled to the base. The release mechanism is configured to disengage the first engagement element from the second engagement element so that the biasing member moves the housing and the latch away from the first engagement element and the latch pushes the toy to launch the toy from the base.

In one embodiment, the toy may be a toy vehicle. In various other embodiments, the weight of the first portion of the latch may be 10%-30% greater than the weight of the second portion of the latch. The latch at rest may be oriented at approximately a 45 degree angle to a horizontal plane, such as 35-55 degrees and the latch may pivot along approximately a 180 degree angle, such as 160-180 degrees. The biasing member may be secured to the base, where in some embodiments the biasing member may be a rubber band.

In some embodiments the second engagement element may be coupled with the first engagement element by nesting. The release mechanism may be activated by, for example, depressing. After the release mechanism is activated, the toy may traverse a pathway without input from a user.

Figure 1:
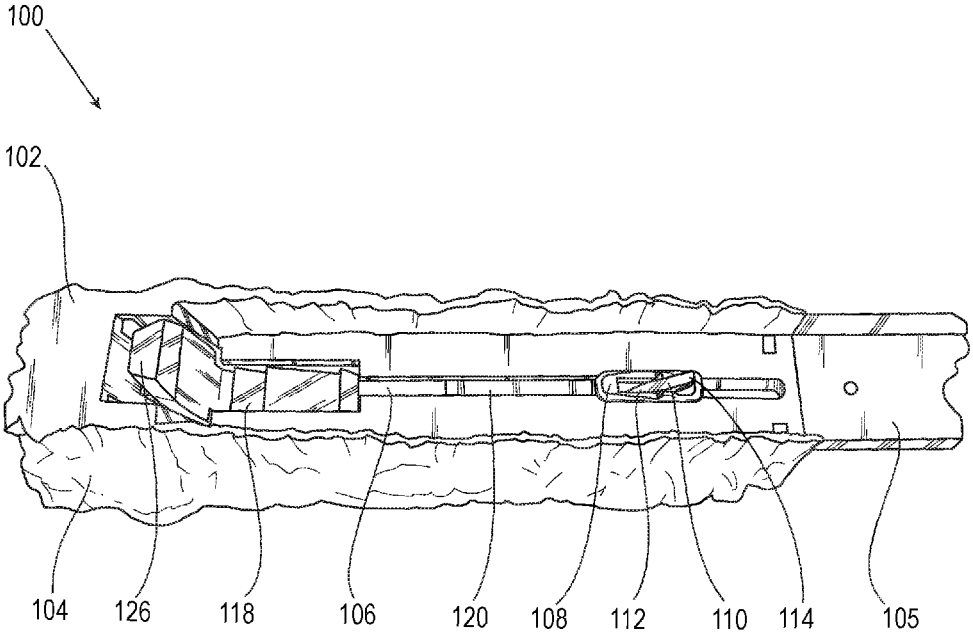
FIG. 1 is a perspective view of an exemplary track set including a toy launcher and a portion of a section of track.

FIG. 1 is a perspective view of an exemplary toy launcher set or track set 100. The toy launcher set 100 includes a base 102 having a first end 104. Base 102 may be coupled to a section of track 105 at its second end opposite the first end 104. The base 102 includes a body in which a slot 106 is formed. A housing 108 is movably coupled to the base 102 so that it can move along the slot 106. This may be accomplished in one embodiment, for example, by fasteners and/or brackets. In another embodiment, the housing 108 may include two portions that are snapped or coupled together on opposite sides of the body of the base to capture the body. The housing 108 may move along the slot 106, for example, by sliding, gliding or in other embodiments, rolling. The housing 108 also has a latch 110 pivotally coupled to the housing 108.

Figure 2:
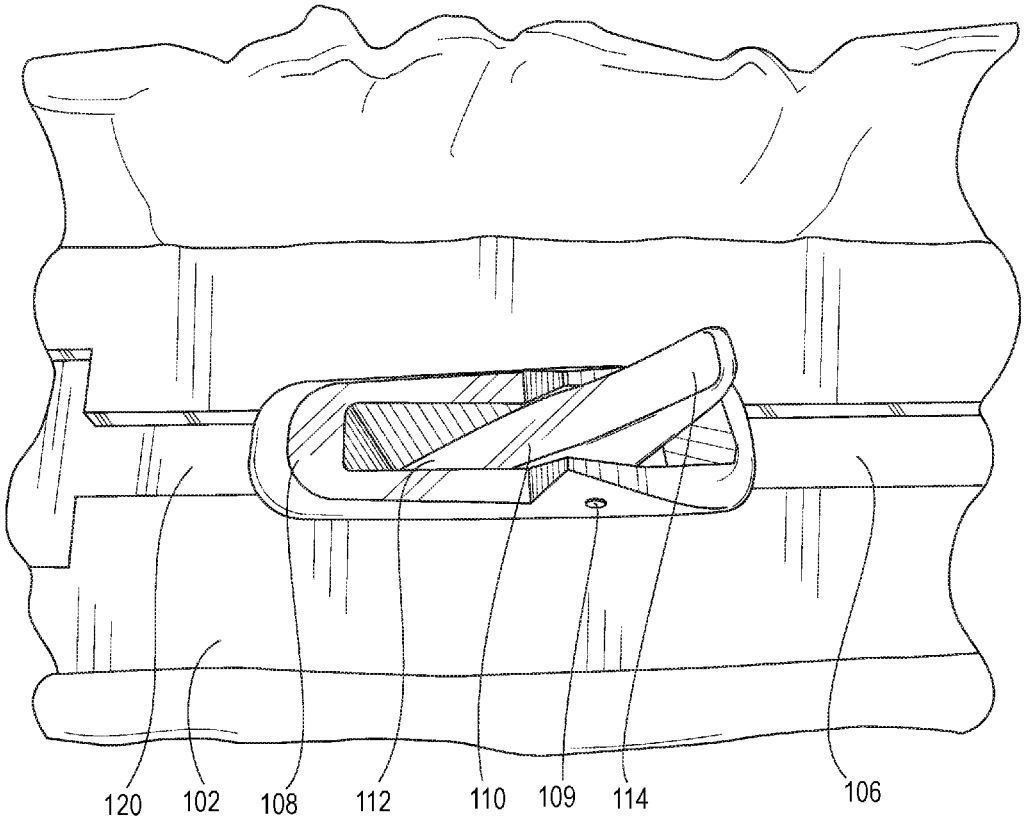
FIG. 2 is a close-up perspective view of a housing and a latch of the toy launcher illustrated in FIG. 1.

FIG. 2 depicts a close-up perspective view of one embodiment of the housing 108 shown in FIG. 1. In one embodiment, the latch 110 is pivotally coupled to the housing 108 by a rod 109. Rod 109 may be press-fit in the housing 108 and through an opening formed in the latch 110, thereby allowing rotation of latch 110 relative to housing 108. Referring to FIGS. 1 and 2, the latch 110 has a first portion 112 encompassing one end of the latch 110, and a second portion 114 on an opposite end of the latch 110. Rod 109 may be located generally near or in the center of latch 110. The weight of the first portion 112 of the latch is greater than the weight of the second portion 114 of the latch. In one embodiment, the weight of the first portion 112 of the latch is 10%-30% greater than the weight of the second portion 114 of the latch. This difference allows the latch 110 to naturally rest with the first portion 112 lower than the second portion 114, with the second portion 114 extending upwardly relative to the housing 108. In one embodiment, the latch 110 at rest is oriented at a 30-60 degree angle to the horizontal plane and pivots between a 120-180 degree angle.

Figure 3:
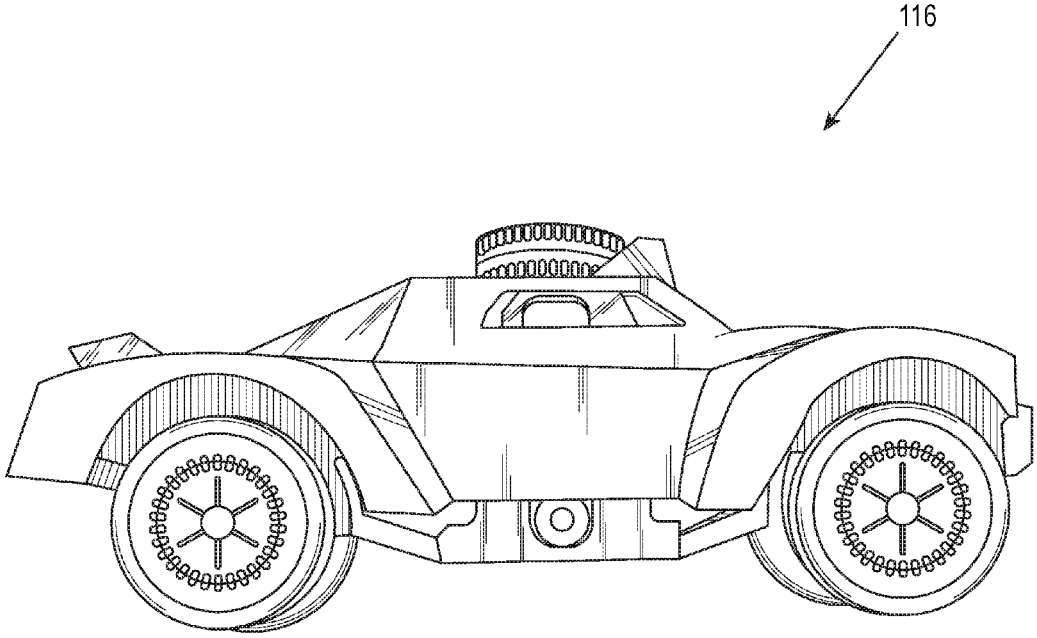
FIG. 3 is a side view of an embodiment of a toy vehicle that can be used with the toy launcher illustrated in FIG. 1.

While the latch 110 is naturally at rest, the second portion 114 of the latch may engage with a toy 116 (such as the toy vehicle illustrated in FIG. 3). The toy 116 may be of any design with at least one axle of the toy 116 being of any design with a surface to be engaged with the latch 110 as described below. For example, the toy 116 may be a vehicle, motorcycle, boat or airplane. FIG. 3 depicts an example embodiment of the toy 116 as a toy vehicle. On the toy 116, the second portion 114 of the latch may engage with, for example, a bumper, an axle, a cutout or a leg. The first portion 112 of the latch corresponds to a rear portion of the toy 116, such that it is oriented toward the rear portion of the toy 116 as the toy 116 is placed on the upper surface of the base 102. In some embodiments, the latch 110 may have a smooth upper surface so that the latch 110 does not interfere with movement of the toy 116 after the latch 110 has launched or pushed forward the toy 116.

Figure 4:
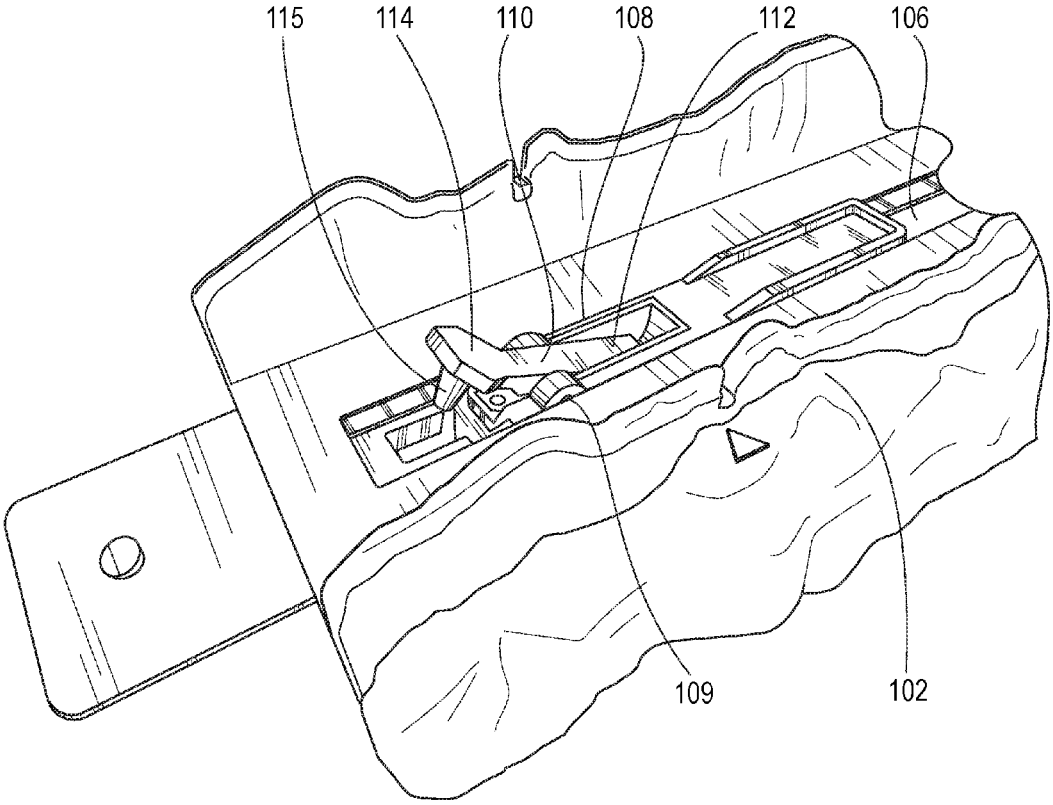
FIG. 4 is a close-up perspective view of an alternative embodiment of a toy launcher.

FIG. 4 shows another embodiment for latch 110. The latch 110 has the first portion 112 encompassing one end of the latch 110, and the second portion 114 on an opposite end of the latch 110. The second portion 114 of the latch has a peg 115 which is a portion of material extending vertically downward from the back or bottom side of latch 110. The second portion 114 of the latch and the peg 115 may engage with, for example, a bumper, an axle, a cutout or a leg on the toy 116. The peg 115 provides surface area for engagement with the portion of the toy 116 and may also provide a lateral force on the toy 116 when launched.

Figure 5:
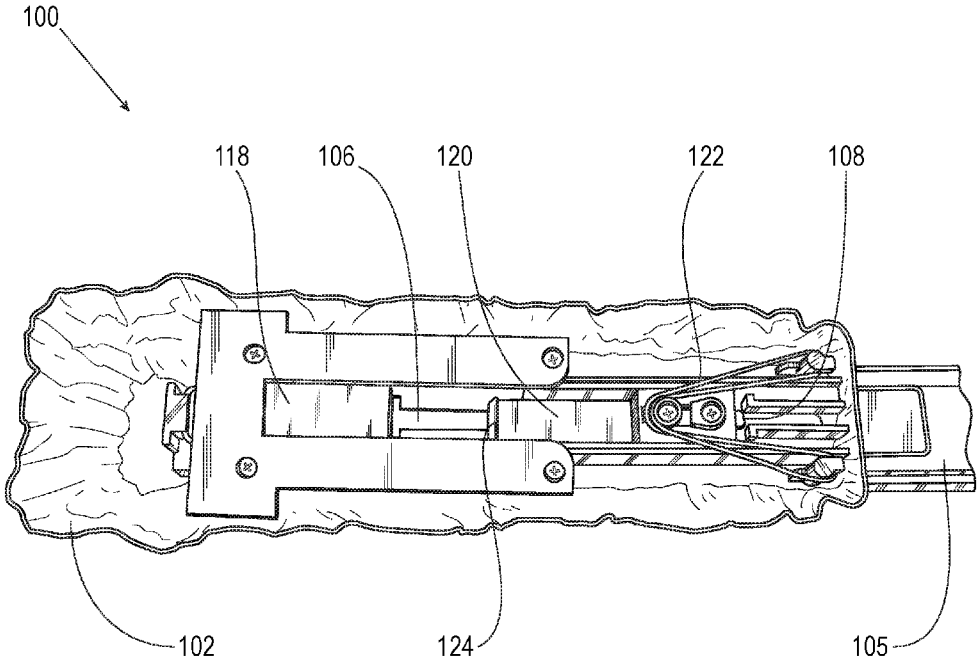
FIG. 5 is a bottom perspective view of an underside of the base of the toy launcher illustrated in FIG. 1 showing the toy launcher in a unloaded state.

Referring back to FIG. 1, a first engagement element 118 is coupled to the base 102 near the first end 104 of the base 102 and a second engagement element 120 is coupled to the housing 108 and movable along the slot 106 therewith. The second engagement element 120 is configured to couple with the first engagement element 118 to retain the housing 108 in a fixed position against a force of a biasing member 122 (FIG. 5). In one embodiment, the first engagement element 118 is contoured with one or more protrusions such as grooves, steps, or ridges. The second engagement element 120 is designed to mate with the protrusions, such as by nesting. The nesting by the second engagement element 120 with the first engagement element 118 corresponds to the shape of the protrusions. FIG. 5 shows a perspective view of one embodiment of the underside of the toy launcher set 100. The second engagement element 120 is configured as a plate which has a flange 124 to couple with the first engagement element 118. In another embodiment, the first engagement element 118 may couple with the second engagement element 120 by a peg/notch configuration.

Figure 6:
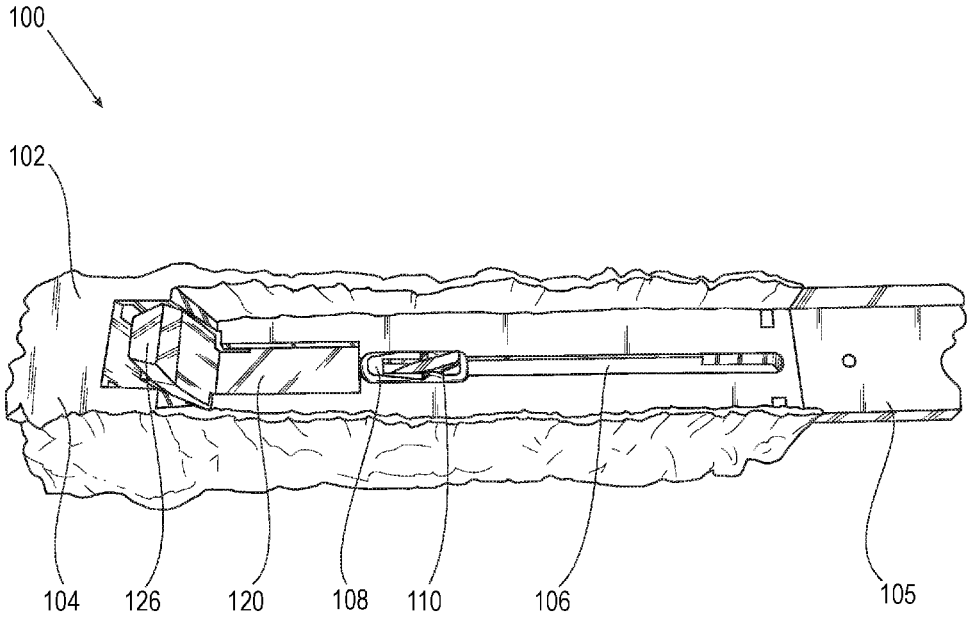
FIG. 6 is a perspective view of the track set illustrated in FIG. 1, with engagement elements in an engaged state.
Figure 7:
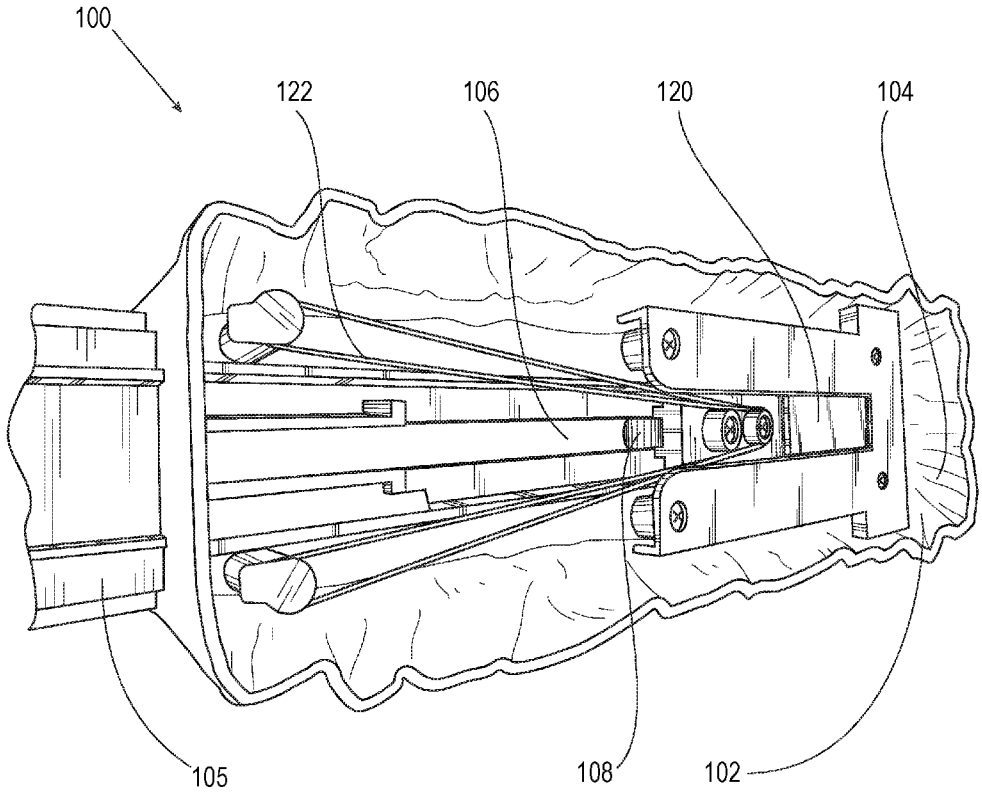
FIG. 7 is a bottom perspective view of the track set illustrated in FIG. 6 with the engagement elements in an engaged state.
Figure 8:
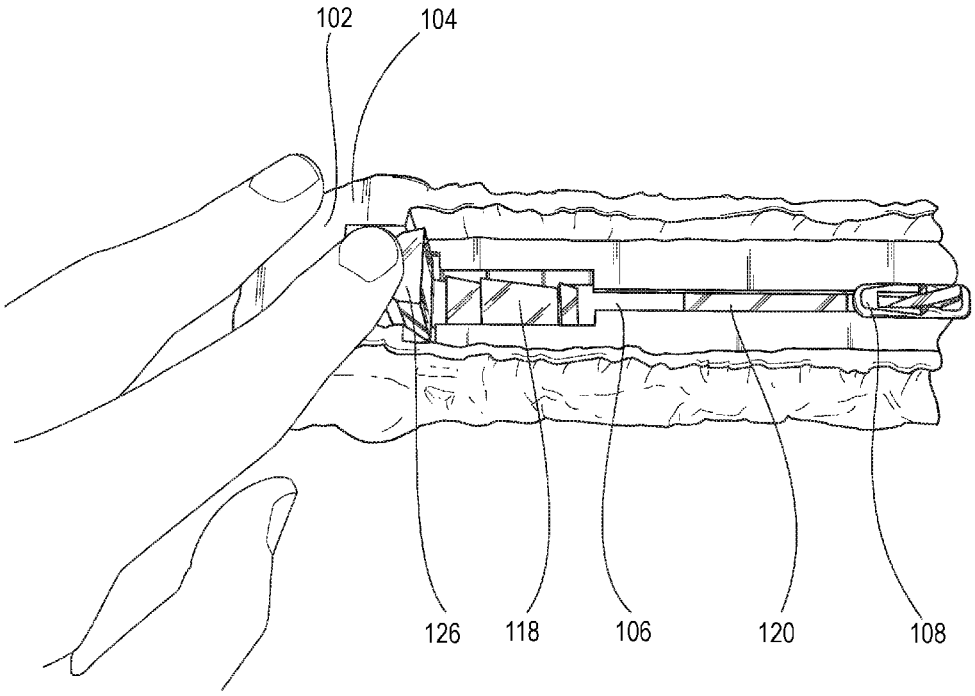
FIG. 8 is a perspective view of the track set illustrated in FIG. 6 in operation.

FIG. 6 is a perspective view of one embodiment of the toy launcher set 100. In this figure, the second engagement element 120 is coupled to the first engagement element 118. The toy 116 may be positioned on the latch 110 for play. FIG. 7 is a perspective view of one embodiment of the underside of the toy launcher set 100 showing the same mode of operation.

Referring to FIG. 7, the biasing member 122 is located on the underside of the toy launcher set 100. The biasing member 122 is coupled to the base 102 and the housing 108. When the second engagement element 120 is coupled to the first engagement element 118, the housing 108 in retained in a fixed position against a force of the biasing member 122. In one embodiment, the biasing member 122 is a rubber band. In other embodiments, the biasing member 122 may be a spring, compressed air, or plunger. FIG. 5 illustrates the biasing member 122 in another mode of operation in which the second engagement element 120 is not coupled to the first engagement element 118.

In operation, the user positions the toy 116 on the latch 110. Referring to FIG. 1 and FIG. 6, a release mechanism 126 is coupled to the base 102. The release mechanism 126 is configured to disengage the first engagement element 118 from the second engagement element 120 so that the biasing member 122 moves the housing 108 and the latch 110 away from the first engagement element 118. After the release mechanism 126 is activated, the housing 108, the latch 110 and the toy 116 move forward. As the latch 110 pivots, the toy 116 is released and propelled forward traversing a pathway, such as track 105, without input from a user. In one embodiment, the release mechanism 126 and the first engagement element 118 are the same component. The release mechanism 126 may be activated by depressing, lifting or rotating. In the embodiment of FIG. 1, release mechanism 126 is a tab that is activated by depressing.

In the embodiments of the toy launcher described herein, the latch 110 and its location and orientation facilitate the launching or propelling of a toy vehicle that has a configuration different than a conventional toy vehicle. An exemplary toy vehicle that can be used with the toy launchers described herein is disclosed in U.S. Provisional Patent Application 62/033,255, filed Aug. 5, 2014, entitled "Toy Vehicle."

The latch 110 allows the toy launcher 100 to launch a toy vehicle 116 from a point in front of the center of gravity or center of mass of the toy vehicle 116. This ability allows the toy vehicle 116 to be launched in any state or configuration. For a toy vehicle that is adjustable, such as toy vehicle 116, a pushing force applied to the rear surface of the toy vehicle will not result in a consistent launching of the toy vehicle. The force applied to the rear surface is behind the center of gravity of the toy vehicle. By launching the toy vehicle 116 by engaging the chassis of toy vehicle 116 as low as possible and in front of the center of gravity or center of mass of the toy vehicle 116, the toy launcher can launch the toy vehicle 116 consistently.

As the latch 110 pushes on the front axle of toy vehicle 116, the toy vehicle 116 is moved forward and the rear axle of the toy vehicle 116 engages the latch 110, which pivots so that it does not hinder the forward movement of the toy vehicle 116.

In addition, typical launchers are designed having the toy loaded onto the launcher and forces are exerted on the rear of the toy when launched. If the toy has a non-rigid structure, this method may be ineffective at launching the toy because the toy may absorb and dampen the force exerted on the rear of the toy causing the toy, i.e., a vehicle, to have less energy therefore only slightly moving along the track. Furthermore, the initial force could deform or cause damage to the toy. By using a weighted, pivoting latch as described herein, the toy is positioned on the launcher and the latch is in contact with a rigid member such as a bumper, an axle, a cutout or a leg. In this way, when the launcher is activated, the force imparted from the latch is fully translated to the toy and the toy is propelled forward along the track with very little losses in energy.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

The invention claimed is:

1. A toy launcher comprising:

a base having a slot;

a housing coupled to the base and configured to move along the slot;

a latch pivotally coupled to the housing, the latch having a first portion and a second portion, wherein a weight of the first portion of the latch is greater than a weight of the second portion of the latch such that after pivotal movement of the latch, the latch always returns to a rest position where the first portion extends downward and the second portion extends upward relative to the base, and wherein the second portion of the latch engages with a first portion of a toy;

a biasing member coupled to the housing to bias the housing from a first position toward a second position relative to the base; and a release mechanism coupled to the base, wherein the release mechanism is configured to release the housing so that, under force from the biasing member, it can move toward the second position allowing the latch to launch the toy from the base.

2. The toy launcher of claim 1, wherein the toy is a toy vehicle.

3. The toy launcher of claim 2, wherein the toy vehicle has a center of gravity and the first portion of the toy vehicle is forward to the center of gravity.

4. The toy launcher of claim 3, wherein a second portion of the toy vehicle, rearward of the first portion of the toy vehicle:

contacts the latch after the release mechanism is actuated and rotates the latch in a first direction away from its rest position; and the latch rotates in a opposite direction, back to its rest position after launch.

5. The toy launcher of claim 1, wherein the weight of the first portion of the latch is 10%-30% greater than the weight of the second portion of the latch to ensure that the latch always returns to its rest position.

6. The toy launcher of claim 1, wherein the latch is oriented at an angle between 35 to 55 degrees to a horizontal plane when in its rest position.

7. The toy launcher of claim 1, wherein when contacted by a second portion of the toy, the latch pivots away from its rest position.

8. The toy launcher of claim 1, wherein the biasing member is secured to the base.

9. The toy launcher of claim 1, wherein the biasing member is a rubber band.

10. A play set including a toy vehicle and a toy launcher, the play set comprising:

a toy vehicle with a center of gravity and a first vehicle engagement portion, the first vehicle engagement portion located forward to the center of gravity;

a base;

a housing configured to move along the base;

a latch pivotally coupled to the housing, the latch having a first portion and a second portion, the latch having a rest position where the first portion extends downward and the second portion extends upward relative to the base, and wherein the second portion of the latch engages with the first vehicle engagement portion;

a biasing member coupled to the housing to bias the housing from a first position toward a second position relative to the base; and a release mechanism coupled to the base and configured to release the housing so that, under force from the biasing member, it can move toward the second position allowing the latch to launch the toy vehicle from the base.

11. The play set including a toy vehicle and a toy launcher of claim 10, wherein a weight of the first portion of the latch is greater than a weight of the second portion of the latch.

12. The play set including a toy vehicle and a toy launcher of claim 11, wherein the weight of the first portion of the latch is 10%-30% greater than the weight of the second portion of the latch to ensure that the latch always returns to its rest position.

13. The play set including a toy vehicle and a toy launcher of claim 12, wherein a second engagement portion of the toy vehicle, rearward of the first engagement portion of the toy vehicle:

contacts the latch after the release mechanism is actuated and rotates the latch in a first direction away from its rest position; and the latch rotates in a opposite direction, back to its rest position after launch.

14. The play set including a toy vehicle and a toy launcher of claim 10, wherein the latch is oriented at an angle between 35 to 55 degrees to a horizontal plane when in its rest position.

15. The play set including a toy vehicle and a toy launcher of claim 10, wherein the base includes a slot and the housing is configured to move along the slot.

16. The play set including a toy vehicle and a toy launcher of claim 10, wherein the biasing member is secured to the base.

17. The play set including a toy vehicle and a toy launcher of claim 10, wherein the biasing member is a rubber band.

18. A play set including a toy and a toy launcher, the play set comprising:

a toy with a center of gravity and a first toy engagement portion, the first toy engagement portion located forward to the center of gravity;

a base having a slot;

a housing coupled to the base and configured to move along the slot;

a latch pivotally coupled to the housing, the latch having a first portion and a second portion, wherein a weight of the first portion of the latch is greater than a weight of the second portion of the latch such that after pivotal movement of the latch, the latch always returns to a rest position where the first portion extends downward and the second portion extends upward relative to the base, and wherein the second portion of the latch engages with the first toy engagement portion;

a biasing member coupled to the housing to bias the housing from a first position toward a second position relative to the base; and a release mechanism coupled to the base, wherein the release mechanism is configured to release the housing so that, under force from the biasing member, it can move toward the second position allowing the latch to launch the toy from the base.

19. The play set including a toy and a toy launcher of claim 18, wherein the weight of the first portion of the latch is 10%-30% greater than the weight of the second portion of the latch to ensure that the latch always returns to its rest position.

20. The play set including a toy and a toy launcher of claim 18, wherein a second engagement portion of the toy, rearward of the first engagement portion of the toy:

contacts the latch after the release mechanism is actuated and rotates the latch in a first direction away from its rest position; and the latch rotates in a opposite direction, back to its rest position after launch.

* * * * *